US005779242A

United States Patent [19]

Kaufmann

[11] Patent Number: 5,779,242

[45] Date of Patent: Jul. 14, 1998

[54] METHOD FOR PLAYERS TO PLAY A TOURNAMENT OF GAMES WHERE GAME SCORES ARE OBTAINED

[75] Inventor: Michael A. Kaufmann, Henderson, Nev.

[73] Assignee: Boyd Gaming Corporation, Las Vegas, Nev.

[21] Appl. No.: 796,594

[22] Filed: Feb. 7, 1997

Related U.S. Application Data

[63] Continuation of Ser. No. 374,839, Jan. 19, 1995, abandoned.

[51] Int. Cl.[6] ..... A63B 67/00

[52] U.S. Cl. ..... 273/459

[58] Field of Search ..... 273/429, 440, 273/454, 459

[56] References Cited

U.S. PATENT DOCUMENTS 4,842,275 6/1989 Tsatskin ..... 273/440 X

OTHER PUBLICATIONS

A flyer advertising the "American Dream Classic" bowling tournament, circa Jan. 1992.

A flyer advertising the "Gold Rush" bowling tournament, circa Aug. 1991.

*Primary Examiner*—William E. Stoll

*Attorney, Agent, or Firm*—Quirk & Tratos

[57] ABSTRACT

A method for determining the winner of an event in which there are numerous players involves the players playing in groups in a first round, with the half of the players in each group having the highest scores advancing to a winners bracket, and the half of the players in each group having the lowest totals moving to a losers bracket. Play in the winners bracket proceeds in rounds until sixteen players remain, with half of the players in each round moving to the next winners round, and half moving to a selected round in the losers bracket. Play continues in the losers bracket in rounds with half of the players advancing and half being eliminated upon receipt of their second loss, until a single player with only one loss remains. The sixteen players with no losses in the winners bracket start a separate double-elimination bracket and play until four players remain. These four players and the single player from the losers bracket play in a championship bracket to determine the winner of the event.

30 Claims, 4 Drawing Sheets

METHOD FOR PLAYERS TO PLAY A TOURNAMENT OF GAMES WHERE GAME SCORES ARE OBTAINED

This application is a continuation application of application Ser. No. 08/374,839 filed Jan. 19, 1995, now abandoned.

FIELD OF THE INVENTION

The present invention relates to a method for determining the winner of series of games or events involving numerous players participating in a tournament.

BACKGROUND OF THE INVENTION

In many instances, it is desirable to determine the best player or team at a given event. Often, however, numerous players or teams are involved, such that a single game can not be played to determine the winner. This is because most games involve only two players or teams playing one another.

Over the years, a variety of tournament or playoff formats have been developed to determine the winner of a multi-participant event. Normally, these tournaments involve players or teams playing one another in pairs, with the winners and/or losers playing one another in a given sequence in order to determine the single winner of the event.

For example, a baseball, basketball or football tournament involving teams, or a bowling, golf or tennis tournament involving individuals, usually comprises some even number of slots in brackets, such as 128, 64, 32, 16, 8 or 4, where the teams or players are paired randomly and play one another in a first round. If the number of participants does not fill all of the spots in the initial bracket, some entrants will have "byes" and will automatically advance to the next round. The winners of the first round games or matches advance to play each other in a second round within a "winners" bracket, and so on until only one unbeaten team or player remains. This team or player is the winner of the event. In this type of tournament, a single loss by a team or player eliminates them from the event. This type of tournament is commonly called a "single-elimination" tournament.

A modification of this method for determining the winner is called the "double-elimination" tournament. In this tournament, losers of matches or games from one or more of the rounds play one another in a separate "losers" bracket, until only one unbeaten player or team remains in the winners bracket, and one once-beaten player or team remains in the losers bracket. These two teams or players then play one another to determine the winner of the event.

In bowling and some other games, players do not play one another, but instead play against themselves to achieve a high score or otherwise "winning" status. In these types of events, straight match-play formats such as those described above are not desirable.

Of course, all of the participants in the event involving a game such as bowling could simply each play the game once, with the player having the highest score or otherwise "winning" result being declared the winner. Most players find this undesirable, however, given that the event then does not last very long and because single game play often leads to winners or losers based on a player having a single very good or bad game, when such a player, over the course of a number of games, normally achieves a different level of play.

SUMMARY OF THE INVENTION

A method for determining the winner of a multi-player event involves players play games in bracket and rounds. All of the players in the event are initially segmented into groups of approximately the same number of players. The players play the game, with approximately half of the players advancing to a winners bracket and the remaining players, or losers, moving to a losers bracket. Preferably, the players advancing as winners are that half of the players who have the highest scores among all of the players in a single group.

The players advancing from the groups in the first round move to a winners bracket play a second winners round, with approximately half of the players advancing to a third winners round, and half losing and moving to the losers bracket.

The players losing in the first round or bracket play a second losers round in the losers bracket, with approximately half moving to the next round of the losers bracket, and approximately half being eliminated from the event when they receive their second loss. The tournament thus employs a "double-elimination" format, as players are only eliminated from the event upon receipt of their second loss.

The players advancing as winners in the losers bracket play the losers of the winners rounds who are moving into the losers bracket. Play continues in the losers bracket in this fashion until a single player having only one loss remains.

Play continues in the winners bracket, with players winning in given rounds advancing to the next winners round, and players losing in a given round moving to the losers bracket, until sixteen players remain. These sixteen players in the winners bracket having no losses then form a new bracket or separate double-elimination sub-tournament, and play until only four players remain, the other twelve suffering a second loss in the sub-tournament and being eliminated from the tournament. Of the four remaining players, two have no losses, and two have one loss. The two players each having no losses play, with the winner being seeded highest in a fourth or championship bracket.

Lastly, the four players from the winners bracket, and the single player from the losers bracket, play in a championship bracket to determine the winner of the event.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
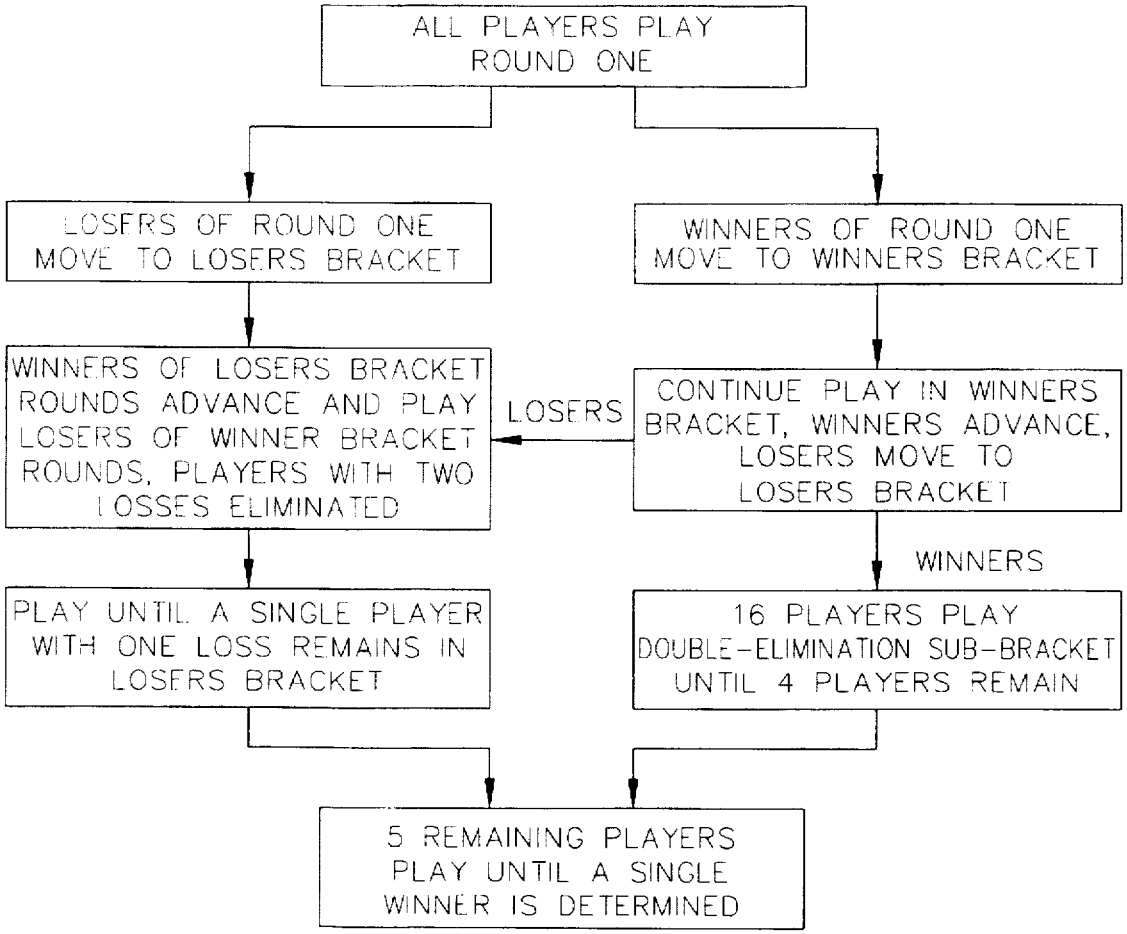
FIG. 1 is a block diagram illustrating tournament play in accordance with the present invention.

FIG. 1 is a block diagram illustrating tournament play in accordance with the method of the present invention. In the present method, all of the players in the event are initially broken into a number of groups each containing a nearly equal number of players. The players within the groups play a game, such as bowling, with approximately half of the players within each group declared winners and advanced to a winners bracket, and the remainder declared losers and moved to a losers bracket. Preferably, the players who are declared the winners of each group are the half of the players having the highest scores or totals for the game in that round.

The players advancing to the winners bracket are again grouped into at least one group, where multiple groups contain nearly the same number of players. Again, approximately half of the players within each group advance as winners to the next round in the winners bracket, and the remaining players, or losers, move to meet those players advancing as winners of one of the rounds of the losers bracket.

In the losers bracket, players winning in given rounds move to the next losers bracket round, which may also include players moving to the losers bracket from a particular winners round. Players receiving a second loss in a round of the losers bracket are eliminated from the tournament, with play continuing in this fashion until a single player with one loss remains.

Play in the winners bracket continues until sixteen (16) players remain, at which time a new bracket or sub-tournament starts. In particular, these sixteen (16) players play one another in double-elimination format, with those players suffering a second loss being eliminated, until four (4) players remain, two (2) with no losses, and two (2) with one loss. The two (2) unbeaten players then play one another, with the winner being seeded higher in a championship bracket.

The four (4) players from the winners bracket and the one (1) player from the losers bracket then play one another in the fourth or championship bracket in a match-play format, until only one (1) player remains, this player declared the winner of the event.

As used herein, "player" is meant to include individuals, teams, groups, or any other entity which is playing an event. "Play" is meant to include participation in a game or event. In particular, the present method is particularly useful for determining the winner of a multi-participant bowling event, where individual players bowl in a round, and the "winners" are those players having the highest scores and the "losers" are those players with the lowest scores. By match-play, it is meant that the players play one another in pairs, with the outcome of a particular match resulting in a winner and loser.

Figure 2:
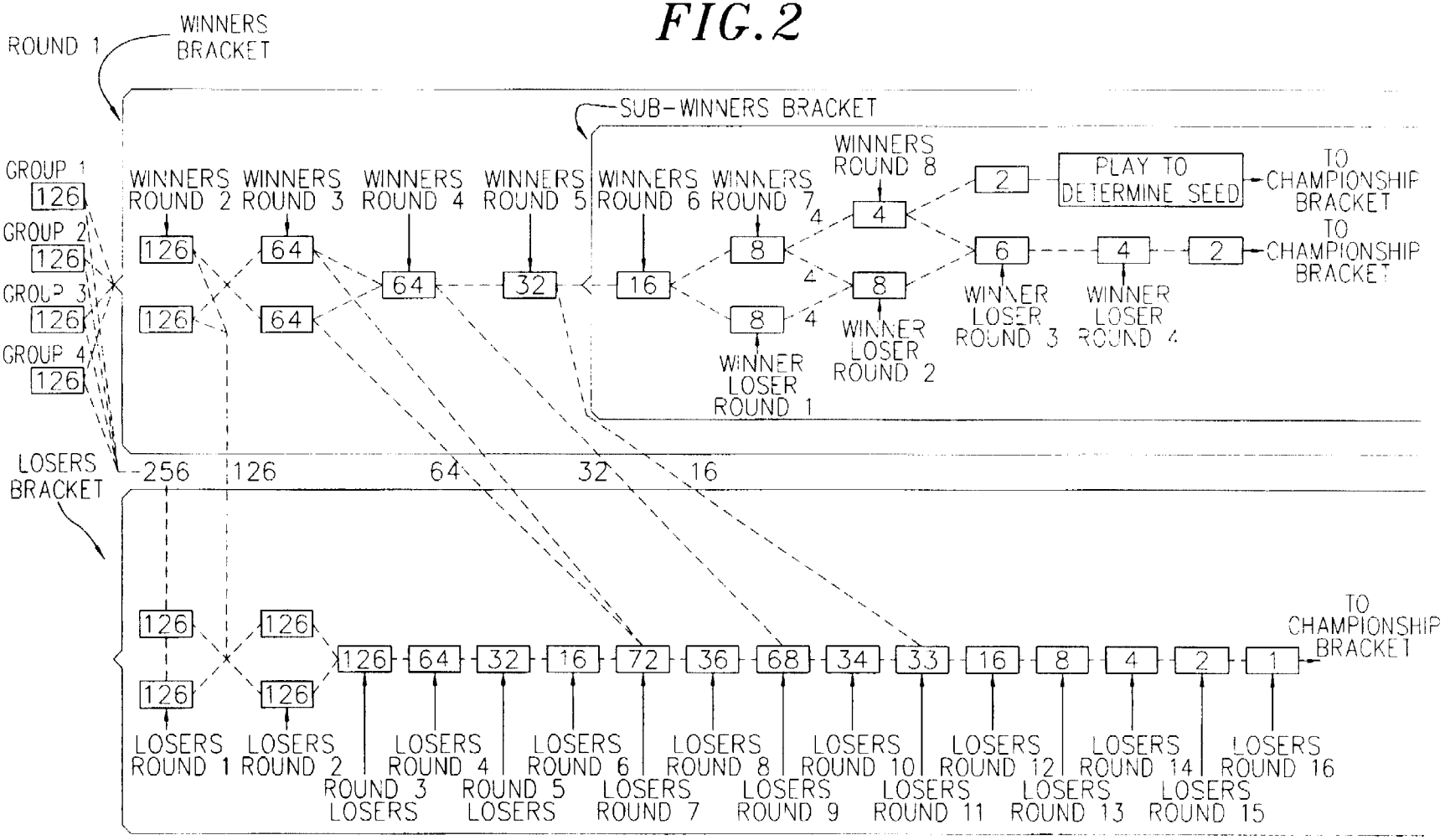
FIG. 2 is a partial schematic diagram of tournament play in accordance with the present invention when there are five-hundred twelve players and continuing until there is a single player remaining in a losers bracket and four players remaining in a winners bracket.

FIG. 2 illustrates the instance in which five-hundred twelve (512) players begin the tournament or event. As described below, the tournament can begin with more or less than this number of players, however.

As illustrated, the five-hundred twelve (512) players are grouped into a number of groups containing nearly the same number of players. In the example illustrated in FIG. 2, four groups of one-hundred twenty-six (126) players are formed.

All of the players in each group play the game in a first round or bracket, preferably a minimum of 50%, and more preferably exactly half of the players in each group, advancing as winners to a winners or second bracket, and with the remaining players moving to a losers or third bracket. In particular, when the event is bowling, all players bowl, with at least half of the players in each group having the highest scores advancing to the winners bracket, and the remaining players moving to the losers bracket.

The players advancing to the winners bracket from round one are re-grouped into at least one group containing nearly equal numbers of players. As illustrated in FIG. 2, two-hundred fifty-six (256) players advance, these players grouped into two groups of one-hundred twenty-six (126) players. These players then play the game in this, a second winners round, with half of the players from each group advancing to a third winners round, and the other players moving to the losers bracket. As illustrated, one-hundred twenty-six (126) players advance to the third winners round, with the same number of losers moving to a second losers round, described in more detail below.

The players (one-hundred twenty-six (126)) in the third winners round play, with half (sixty-four (64)) advancing to a fourth winners round, and half (sixty-four (64)) moving to a seventh losers round, described in detail below.

Those players (sixty-four (64)) advancing as winners from the third winners round play in the fourth winners round, with half (thirty-two (32)) advancing to a fifth winners round, and half (thirty-two (32)) moving to a ninth losers round, described in detail below.

The players (thirty-two (32)) advancing as winners from the fourth winners round play in a fifth winners round, with half (sixteen (16)) advancing to a sixth winners round, and half (sixteen (16)) moving to an eleventh losers round, described in detail below.

Once the number of players in the winners bracket, in this case at the sixth winners round, reaches sixteen (16) players, a sub-winners bracket is formed. These sixteen (16) players preferably play in double-elimination format until only four (4) players remain: two (2) players with one loss and two (2) players having no losses.

In particular, the (16) players in the sixth winners round play, yielding eight (8) winners who move to a seventh winners round, and eight (8) losers who move to a first winners/loser round. The eight (8) players in the first winners/loser round play, with four (4) players eliminated, and four (4) advancing to a winners/loser round two.

The eight (8) players advancing to the seventh winners round play, with four (4) advancing as winners to an eighth winners round, and four (4) moving as losers to the winners/losers round two. Then the players (eight (8)) in winners/losers round two play, with four (4) being eliminated, and four (4) advancing to a winners/loser round three.

The four (4) players in winners round eight play, with two (2) players advancing as unbeaten winners to a fourth or championship bracket (see FIGS. 4 and 5), and two players (2) moving to the winners/loser round three as one-time losers. Winners/loser round three thus comprises six (6) players, who then play. Four (4) of these players advance to a winners/loser round four, and two (2) players are eliminated. Lastly, the four (4) players in winners/loser round four play, with two (2) players being eliminated, and two (2) players advancing to the championship bracket, each having one loss.

Now returning to the losers bracket, the players moving to the losers bracket from round one are grouped into a number of groups containing nearly equal numbers of players. FIG. 2 illustrates two-hundred fifty-six players (256) players grouped into two groups of one-hundred twenty-six (126) players. These players play in a first losers round, with half moving to a second losers round, and half being eliminated upon receiving their second loss.

The second losers round then comprises those players advancing from the first losers round and those players moving down from the second winners round having losses. In FIG. 2, the second losers round comprises two-hundred fifty-six (256) players grouped into two groups of one-hundred twenty-six (126) players. These players play the game, with half of the players from each group advancing as winners to a third losers round and half of the players being eliminated from the tournament upon receipt of their second loss.

The third losers round thus comprises one-hundred twenty-six (126) players advancing from the second loser round. As illustrated, these players play in a single group, with half of the players (sixty-four (64)) advancing to a fourth losers round and half of the players (sixty-four (64)) being eliminated.

The players advancing (sixty-four (64) players) play one another in a fourth losers round, with half advancing (thirty-two (32)) and half (thirty-two (32)) being eliminated. Those advancing (thirty-two (32)) move and play in a fifth losers round, with half (sixteen (16)) advancing and half (sixteen (16)) eliminated. Those advancing (sixteen (16) from the fifth losers round play one another in a sixth losers round, with half (eight (8)) advancing to a seventh losers round and half (eight (8)) eliminated.

Those advancing from the sixth losers round (eight (8) players) meet the losers of the third winners round to form the seventh losers round comprising seventy-two (72) players. These players play, with half (thirty-six (36)) advancing to an eighth losers round, and half (thirty-six (36) eliminated.

The players (thirty-six (36)) players advancing to the eighth losers round then play, with half (eighteen (18)) players advancing to a ninth losers round, and half (eighteen (18)) being eliminated.

The ninth losers round comprises the players (eighteen (18)) advancing from the eighth losers round, and the players who lost in winners round four (thirty-two (32) players). These players (sixty-eight (68)) play, with half (thirty-four (34)) advancing to a tenth losers round and the other half (thirty-four (34)) being eliminated.

The players advancing to the tenth losers round play, with half (eighteen (18)) being eliminated from the tournament upon receipt of their second loss, and half (eighteen (18)) advancing to an eleventh losers round.

The eleventh losers round comprises the players advancing from the tenth losers round (eighteen (18) players) and the players (sixteen (16) players) moving down as losers from the fifth winners round. These players (thirty-three (33) play, with half (in this case sixteen (16)) advancing, and half (in this case seventeen (17)) being eliminated.

Those players advancing from the eleventh losers round play in a twelfth loser round, and so on through the thirteenth, fourteenth, and fifteenth losers rounds, where in each round half of the players advance as winners and half of the players are eliminated as losers, until a single player having only one loss, remains in the losers bracket.

Figure 4:
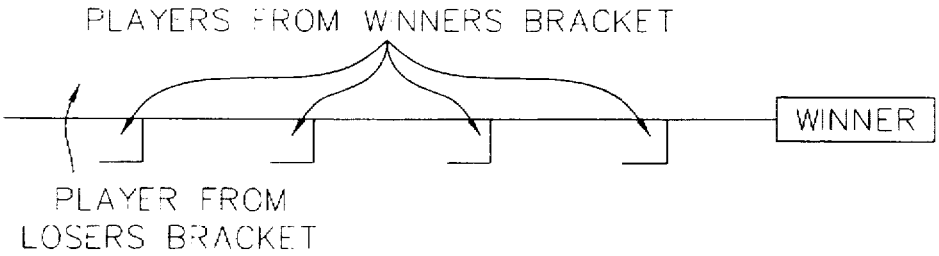
FIG. 4 is a schematic diagram of a championship bracket in which the five remaining players from the winners and losers brackets illustrated in FIGS. 2 or 3 play to determine a winner.

As illustrated in FIG. 4, the five (5) remaining players (the four (4) players from the winners bracket, and the single player from the losers bracket) then play one another in the championship bracket, preferably in "step" fashion, to determine the winner of the event.

To determine the order of play, before the fourth bracket is formed, the two (2) unbeaten players from the winners bracket play, with the winner being seeded highest, and the loser being seeded second highest. The third seed is the player from the last winners/loser round having the higher score than the other player from the last winners/loser round, who ends up seeded fourth. If the two players each having one loss advancing to the fourth bracket from the last winners/loser round have the same score, an additional game may be played, a coin tossed, or the like to determine who is seeded higher.

Then single player from the losers bracket having one loss plays the lowest seeded player from the winners bracket in a first match. The winner of this first match then plays the third seeded player (the other of the players having one loss which came from the last winners/loser round) in a second match. The winner of this second match then plays one of the second seeded player (the player who lost the game as between the two previously unbeaten players from the winners bracket) in a third match.

The winner of the third match then plays the remaining, unbeaten player in a fourth match. If the winner of this fourth match is the winner of the third match (i.e. the remaining undefeated player is beaten), then the two players from the fourth match play a fifth match with the winner of the fifth match being declared the winner of the event. If the winner of the fourth match is the undefeated player, then the winner of the event or tournament is the undefeated player.

While the brackets and rounds have been numbered and arranged in a particular manner above, the number of brackets, their arrangement and numbering, can be changed without departing from the scope of the invention. Further, the number of groups in a given round, the number of players within a group, and the number of players advancing can be varied.

Figure 3:
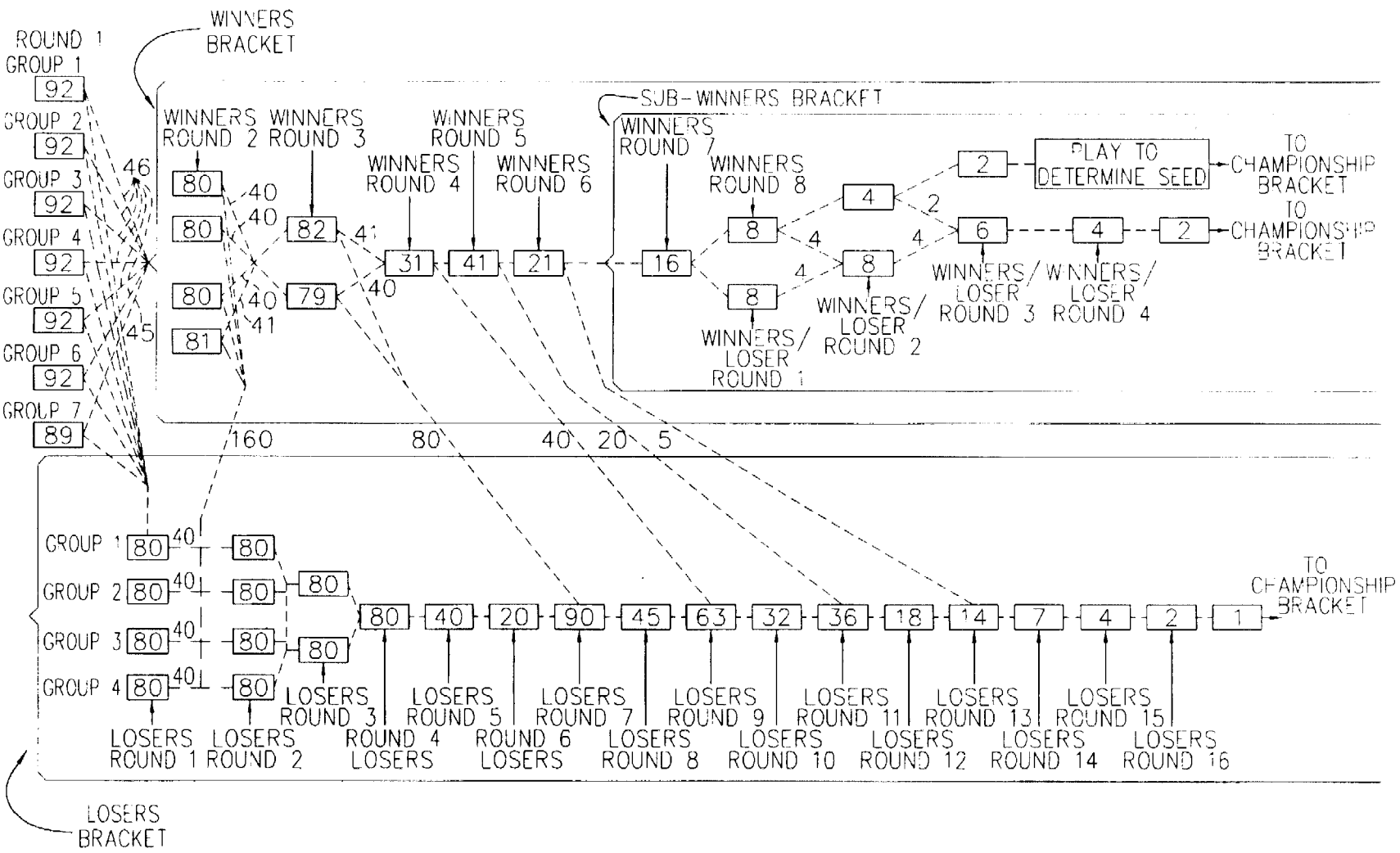
FIG. 3 is an alternate partial schematic diagram of tournament play in accordance with the present invention when there are six-hundred forty-one players who play until a single player remains in a losers bracket and four players remain in a winners bracket.

FIG. 3 illustrates a second example of the present invention. In this Figure, six-hundred forty-one (641) players initially begin the tournament, and are broken into the groups having the number of players designated therein. As illustrated, when a different number of players starts the tournament, the number of players advancing in each round varies. Furthermore, the number of rounds in each of the winners and losers brackets which must be played to result in the sixteen players who play the sub double-elimination winners tournament and the single player in the losers bracket having one loss, varies.

Thus, while the method described above is illustrated as applying to a particular number of players, the method is equally applicable when there is initially a larger amount of players or smaller amount of players. In the instance in which more players start the tournament, more rounds must generally be played. In the instance where a smaller number of players are in the tournament, a smaller number of rounds are normally played.

In any case, eventually, there are preferably sixteen (16) players having no losses in the winners bracket who begin a separate double-elimination bracket. Further, eventually, the number of players in the losers bracket will, by virtue of player elimination, reach one.

The number of players advancing as "winners" in a given round does not need to be half, or even approximately half of the players. For example, the top two-thirds, or possibly only the top quarter or third, of the players in a given group may advance. Changing the number of players who advance correspondingly changes the number of rounds necessary to complete play.

As described above, starting with the third winners round, the losers of all subsequent winners rounds preferably move to a round of the losers bracket equal to two times the round in which the player lost, plus one. Thus, the losers of the third winners round move to the seventh losers round, the losers of the fourth winners round move to the ninth losers round, the losers of the fifth losers round move to the eleventh losers round, as so on. It is possible, however, for the losers of these winners round to move to a variety of different rounds in the losers bracket.

As a further aspect of the present invention, play in the winners bracket may also continue with losers moving to the losers bracket until there are only eight (8) or four (4) players having no losses. In such instance, the losers of these winners rounds move to a particular losers round to play those remaining in the losers bracket who remain with only one loss. The remaining eight (8) or four (4) players in the winners bracket then play in double-elimination format until there are four (4) players, two (2) each with no losses and two (2) each with one loss.

Alternatively, the sub-winners bracket could be formed earlier, as having more than sixteen (16) players, all of who play in double-elimination format to reach the result of four (4) players as described above.

Figure 5:
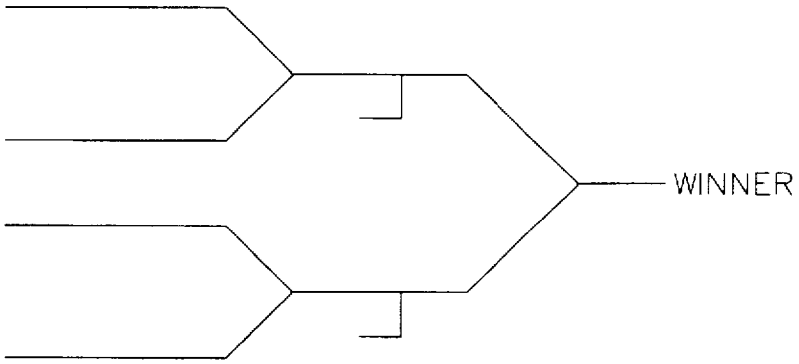
FIG. 5 is a partial schematic diagram illustrating an alternate embodiment championship bracket for use with the method of the present invention where two players remain in the losers bracket, these two players playing the four players from the winners bracket of FIGS. 2 or 3 to determine a winner.

In an alternate embodiment, play continues in the losers bracket until there are two (2) players with one loss each. In such instance, the championship bracket described above would have six slots, as illustrated in FIG. 5. In this instance, the two players with one loss from the losers bracket then meet the two players from the winners bracket each having a single loss, in first and second matches. The losers of these two matches, each having one loss, are eliminated. The winners of these two matches play the two players from the winners bracket each having no loss in third and fourth matches. The losers of these matches are eliminated, and the remaining two players play a fifth match to determine the winner of the event.

As a further aspect of the present invention, winners of particular rounds may be awarded prizes. In this form of the invention, each player pays a fee or bet to enter the contest. Each player who wins in the first round is paid a first amount, each player who continues and wins in the second round is paid a second amount, and so on. Preferably, those players in the winners bracket advancing in each winners round to the next winners round are given a prize equal to two times the amount of a player in the losers bracket who advances from one losers round to the next. In this fashion, when the losers of a particular winners round move down to the losers bracket, the players they meet in the next losers bracket round have won (by virtue of those players advancing in the losers bracket having played two times as many rounds) the same amount of money.

Further, one or more of the players advancing in to the end of the losers bracket may be awarded prizes. For example, the second and third place finishers (those who lost in the round or rounds before only a single player remains in the losers bracket) may be awarded a prize.

It is also contemplated that those players who advance to the final round or the above-described championship bracket be awarded prizes in relation to their finishing order, with the winner of the entire event winning the largest amount or "grand prize."

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method for multiple players to play a tournament of games where scores are obtained comprising:

ascertaining the number of players for the tournament;

determining from the number of players the number of rounds to be played in a winners bracket and a losers bracket;

the players playing an initial game;

using approximately the median score of the players of the initial game to declare approximately half of the players winners and half losers of the initial round, said declared winners advancing to the winners bracket and the declared losers falling to play in the losers bracket;

in the winners bracket, the advancing field of players playing the game in each round to each obtain a score, using the players' individual scores to determine a dividing score to divide the field of each round into winners having individual scores at or above said dividing score and the remainder losers, the winners advancing to fill the next round in the winners bracket and the losers falling to the losers bracket;

in the losers bracket, the advancing field of players and those declared losers from each round in the winners bracket merging and playing the game at a predetermined round in the losers bracket to each obtain a score, using the players' scores to determine a score to divide the field of each round in the losers bracket into winners and losers, the declared winners advancing to the next round in the losers bracket to play with players falling from the winners bracket and merged into said next round, it any, and eliminating the losers of the round in the losers bracket from the tournament;

playing corresponding rounds in the winners and losers brackets to advance at least one player from the winners bracket having not once been declared a loser and one player from the losers bracket having only once been declared a loser and eliminating the remainder of players, said advancing players playing to determine the tournament champion.

2. The method of claim 1 including determining and using a score in at least one round to declare winners and losers, such as to divide the field of players into approximately half winners and the remainder losers.

3. The method of claim 1 further including the awarding of prize money to the declared winners of each round.

4. The method of claim 3 further including awarding increasing amounts of prize money to declared winners for each succeeding round.

5. The method of claim 4 including awarding prize money for the declared winners of a round in the losers bracket in an amount less than the amount awarded to the declared winners of a corresponding round in the winners bracket.

6. The method of claim 5 further including dropping declared losers from rounds of the winners bracket and inserting them into later rounds of the losers bracket such that the accumulated prize money for players in the field for the round in the losers bracket is substantially the same.

7. The method of claim 6 of dropping declared losers from a predetermined winners bracket rounds to a losers bracket round according to the following equation, $$RL=(RW\times 2)+1$$

where RL is the losers bracket round and RW is the winners bracket round producing the declared losers.

8. The method of claim 1 wherein rounds of the winners bracket are played until sixteen players not once having been declared losers are determined, the method further including playing a sub-tournament in rounds with the said sixteen players advancing in the winners bracket, using the players' individual scores in each round of the sub-tournament to determine a dividing score to divide the field of each round into approximately half winners having individual scores at or above the dividing score and the remaining half losers, said sub-tournament having a winners bracket and a losers bracket, the declared winners in the sub-tournament winners bracket advancing to the next sub-tournament winners bracket round and said declared losers dropping to play in rounds in the sub-tournament losers bracket, the declared losers in any round in the sub-tournament losers bracket eliminated from the tournament, said sub-tournament reducing the field of sixteen players to two players not once having been declared losers in the sub-tournament and two players from the sub-tournament losers bracket only once having been declared losers, said four players advancing with a player advancing from the loser's bracket to play in a championship bracket to determine a champion.

9. The method of claim 8 further including seeding the two players advancing from the sub-tournament winners bracket for the championship round by the players playing a game, the winner seeded number 1 and the loser seeded number 2.

10. The method of claim 9 further including seeding the two players advancing from the sub-tournament losers bracket for the championship round by the players playing a game, the winner seeded number 3 and the loser seeded number 4.

11. The method of claim 10 further including seeding the player advancing from the losers bracket number 5 for the championship round.

12. The method of claim 8 further including playing the championship round as match play with the following games, (1) the fifth seed playing the fourth seed, (2) the winner of game (1) playing the third seed, (3) the winner of game (2) playing the second seed, and (4) the winner of game (3) playing the first seed, the winner of game (4) declared the champion.

13. A method for tournament play by a plurality of players playing a game of the type where scores are obtained, the method comprising:

establishing a championship bracket to be played by five players, four who advance from a winners bracket and one from a losers bracket;

all players playing an initial round for the game, each obtaining a score;

determining a median for the scores of the initial round and based upon that median first round score, declaring approximately half the first round players winners and the remainder losers, said first round winners advancing to the first round of the winners bracket and said losers advancing to play a first round in the losers bracket;

determining for at least a plurality of succeeding rounds in the winners bracket the median score and based thereon declaring approximately half of the players winners and half losers, the declared winners playing in the next winners bracket round and the declared losers falling to play in a predetermined losers bracket round;

said first initial round losers playing in the first round of the losers bracket, determining for at least the first round of the loser's bracket and a plurality of succeeding rounds the median score and based thereon declaring approximately half of the players winners and half losers, the declared winners advancing to the next losers bracket round to play with other advancing players in the losers bracket and players merged as a result of being declared losers in a winners bracket round, the declared losers of each round of the losers bracket eliminated from the tournament;

continuing play in the winners bracket until sixteen players remain who have not once been declared losers in any previous round and one player remains in the losers bracket having only once been declared a loser, said one player advancing to the championship bracket;

playing a sub-tournament in rounds with the remaining sixteen players advancing in the winners bracket, using the players' individual scores in each round of the sub-tournament to determine a dividing score to divide the field of each round into approximately half winners having individual scores at or above the dividing score and the remaining half losers, said sub-tournament having a winners bracket and a losers bracket, the declared winners in the winners bracket advancing to the next sub-tournament winners bracket round and said declared losers dropping to play in rounds in a sub-tournament losers bracket, the declared losers in any round in the sub-tournament losers bracket eliminated from the tournament, said sub-tournament reducing the sixteen players to two players not having been declared losers in the sub-tournament and two players only once having been declared losers in the sub-tournament, said four players advancing with said player advancing from the loser's bracket to play in a championship bracket to determine a champion;

seeding said four players advancing from the sub-tournament bracket one through four and seeding the player advancing from the losers bracket five; and playing the championship bracket with match play with the following games, (1) the five seed playing the four seed, (2) the winner of game (1) playing the three seed, (3) the winner of game (2) playing the two seed, and (4) the winner of game (3) playing the one seed, the winner of game (4) declared the champion.

14. The method of claim 13 further including the awarding of prize money to the declared winners of each round.

15. The method of claim 14 further including awarding increasing amounts of prize money for each round.

16. The method of claim 15 further including awarding prize money for the declared winners of a round in the losers bracket in an amount less than the amount awarded to the declared winners of a corresponding round in the winners bracket.

17. The method of claim 16 further including dropping declared losers from rounds of the winners bracket into later rounds of the losers bracket such that the accumulated prize money for players playing the in the round in the losers bracket is substantially the same.

18. A method for a number of players to play a tournament of games to determine a champion, said games of the type where each player playing the game receives a score, the method comprising:

ascertaining the number of players for the tournament;

determining from the number of players the number of rounds to be played in a winners bracket and a losers bracket;

all players playing an initial round R1 of at least one game, the players scores and the number of rounds to be played determining a score to declare winners and losers, said declared winners advancing into a winners bracket played according to the following format,

```
R1W - - R2W - - R3W - - RnW - - F1
|       |       |       |
A       A       A       A
```

and the declared losers falling to play the losers bracket played according to the following format,

```
R1L - - R2L - - R3L - - RnL - - F2
|       |       |       |
E       E       E       E
```

wherein R2W–RnW are the rounds to be played in the winners bracket and R1L–RnL are rounds to be played in the losers bracket, using the player's scores in each round R2W–RnW to determine a score to declare winners to advance to the next round in the winners bracket with the remainder declared losers A, losers A in round R2W falling to play in round R2L and losers A in succeeding rounds in the winners bracket falling to play in losers bracket rounds according to the following equation $$RL=(RW\times 2)+1$$

where RL is the round in the losers bracket and RW is the winners bracket round producing losers A, and using the scores in each round R1L–RnL to determine a score to declare winners to advance and, with any declared losers A, fill the next round in the losers bracket and the remainder and eliminating declared losers E from the tournament;

and at least one player $F_1$ not having been declared a loser in the winners bracket and one player $F_2$ having been declared a loser once advancing from the losers bracket to play in a championship bracket, and declaring the winner of the championship bracket the tournament champion.

19. The method of claim 18 further including using a median score to declare winners and losers which and define approximately half of the players winners and the remainder losers.

20. The method of claim 18 further including the awarding of prize money to the declared winners of each round.

21. The method of claim 20 further including awarding increasing amounts of prize money for each round.

22. The method of claim 20 including awarding the prize money awarded for the declared winners of a round R1L–RnL in the losers bracket in an amount less than the amount awarded to the declared winners of a corresponding round R2W–RnW in the winners bracket.

23. The method of claim 22 further including dropping declared losers A from rounds of the winners bracket into later rounds to the losers bracket such that the accumulated prize money for players in the round is approximately the same.

24. The method of claim 23 including dropping declared losers A from rounds R3W–R5W to rounds in the losers bracket according to the following formula $$RL=(RW\times 2)+1$$

where RL is the round in the losers bracket and RW is the winners bracket round producing losers A.

25. The method of claim 18 wherein sixteen players $F_1$ are advanced from the winners bracket and one player $F_2$ from the losers bracket, the method further including said sixteen players $F_1$ playing a sub-tournament to advance two players not having been declared losers and two players having been declared losers once, said four players advancing to a championship bracket with the player $F_3$ advancing from the losers bracket.

26. The method of claim 25 further including seeding the players advancing to the championship bracket.

27. The method of claim 26 including seeding the player $F_3$ advancing from the losers bracket fifth, seeding the players from the sub-tournament having been declared losers once, third and fourth and seeding the players advancing not having been declared losers, first and second.

28. The method of claim 27 including the players advancing from the sub-tournament playing one game to determine said fourth through first seeding.

29. The method of claim 27 wherein the players advancing from the sub-tournament not having been declared losers playing a game to determine first and second seeding.

30. The method of claim 26 including playing the championship bracket as match play with the following games, (1) the fifth seed playing the fourth seed, (2) the winner of game (1) playing the third seed, (3) the winner of game (2) playing the second seed, and (4) the winner of game (3) playing the first seed, the winner of game (4) declared the champion.

* * * * *